US009723423B2

(12) United States Patent
Uchida

(10) Patent No.: US 9,723,423 B2
(45) Date of Patent: Aug. 1, 2017

(54) ACOUSTIC TRANSDUCER

(71) Applicant: OMRON Corporation, Kyoto (JP)

(72) Inventor: Yuki Uchida, Shiga (JP)

(73) Assignee: OMRON Corporation, Kyoto (JP)

( * ) Notice: Subject to any disclaimer, the term of this patent is extended or adjusted under 35 U.S.C. 154(b) by 53 days.

(21) Appl. No.: 14/630,917

(22) Filed: Feb. 25, 2015

(65) Prior Publication Data

US 2015/0264476 A1 Sep. 17, 2015

(30) Foreign Application Priority Data

Mar. 14, 2014 (JP) ..... 2014-052736

(51) Int. Cl.
*H04R 31/00* (2006.01)
*H04R 19/00* (2006.01)

(52) U.S. Cl.
CPC ..... *H04R 31/00* (2013.01); *H04R 19/005* (2013.01)

(58) Field of Classification Search
CPC ..... H04R 19/005; H04R 19/04; H04R 19/00; H04R 19/016; H04R 2499/11; H04R 2201/003; H04R 1/04; H04R 1/02
See application file for complete search history.

(56) References Cited

U.S. PATENT DOCUMENTS 8,379,887 B2 2/2013 Kasai et al.
8,541,852 B2 9/2013 Kasai
8,542,853 B2 * 9/2013 Dehe ..... H04R 19/005 381/174
9,206,031 B2 * 12/2015 Jenkins ..... B81B 3/0021
9,299,671 B2 * 3/2016 Liu ..... H01L 27/092
9,319,798 B2 * 4/2016 Okugawa ..... H04R 19/005
9,420,380 B2 * 8/2016 Inoue ..... H04R 19/00
2006/0008097 A1 * 1/2006 Stenberg ..... H04R 19/04 381/113
2007/0056377 A1 * 3/2007 Matsubara ..... G01L 9/0042 73/718
2008/0075308 A1 * 3/2008 Wei ..... H04R 19/005 381/175
2010/0002895 A1 * 1/2010 Notake ..... B81B 3/0051 381/174
2010/0065930 A1 * 3/2010 Nakatani ..... B81C 1/00476 257/415
2011/0108933 A1 * 5/2011 Nakatani ..... B81C 1/00238 257/415

(Continued)

FOREIGN PATENT DOCUMENTS

JP 2008085507 A * 4/2008
JP 2008-301430 A 12/2008
JP 2011-239324 A 11/2011

*Primary Examiner* — Davetta W Goins
*Assistant Examiner* — Jasmine Pritchard
(74) *Attorney, Agent, or Firm* — Osha Liang LLP

(57) ABSTRACT

An acoustic transducer has a back plate having a fixed electrode, a diaphragm that is opposed to the back plate with a gap interposed therebetween and that serves as a movable electrode, and a stopper protruding from a face of the back plate or the diaphragm, which is on a side of the gap. The stopper includes a conductive section electrically isolated from the fixed electrode and the movable electrode. The conductive section comes in contact with a front face of the fixed electrode or the movable electrode opposed to the stopper through deformation of the diaphragm.

20 Claims, 13 Drawing Sheets

(56) References Cited

U.S. PATENT DOCUMENTS

| | | | | |
|---|---|---|---|---|
| 2011/0127624 | A1* | 6/2011 | Nakatani | H04R 19/005 257/416 |
| 2012/0319217 | A1* | 12/2012 | Dehe | B81B 3/0072 257/415 |
| 2013/0069179 | A1* | 3/2013 | Ishimoto | H04R 19/005 257/416 |
| 2014/0239352 | A1* | 8/2014 | Wang | H04R 19/04 257/254 |
| 2015/0264462 | A1* | 9/2015 | Okugawa | H04R 19/005 381/174 |
| 2015/0264464 | A1* | 9/2015 | Okugawa | H04R 19/005 381/174 |
| 2016/0094918 | A1* | 3/2016 | Uchida | H04R 19/005 381/120 |

* cited by examiner 10
20
22 (21)
23
24a
25
13

ACOUSTIC TRANSDUCER

CROSS-REFERENCE TO RELATED APPLICATION

This application claims priority to Japanese Patent Application No. 2014-052736 filed with the Japan Patent Office on Mar. 14, 2014, the entire contents of which are incorporated herein by reference.

BACKGROUND

Field

The present invention relates to an acoustic transducer.

Related Art

As well known, compact capacitor acoustic transducers have been manufactured by using MEMS (Micro Electro Mechanical Systems) (see Japanese Unexamined Patent Publication No. 2011-239324, U.S. Unexamined Patent Application Publication No. 2012/0319217, and Japanese Unexamined Patent Publication No. 2008-301430, for example).

A configuration of an existing general acoustic transducer will be described below with reference to FIG. 15.

As shown, the acoustic transducer has a configuration where a diaphragm 60 serving as a movable electrode is opposed with a gap interposed therebetween to a back plate 70 having a fixed electrode 72 provided in a plate 71 made of an insulating material.

The back plate 70 is provided with a plurality of sound holes 75 through which acoustic vibration passes. Moreover, the back plate 70 is provided with a plurality of stoppers 74 that protrudes from the plate 71 to penetrate the fixed electrode 72 and that is made of the same material as the material for the plate 71.

The stoppers 74 are provided to prevent the diaphragm 60 from adhering to the back plate 70 (fixed electrode 72) at manufacturing and use of the acoustic transducer.

More specifically, in a cleaning process after etching of a sacrifice layer in manufacturing of the acoustic transducer, moisture enters the gap between the diaphragm 60 and the fixed electrode 72. Moreover, during use of the acoustic transducer, moisture of moist air or water may enter the gap between the diaphragm 60 and the fixed electrode 72. Then, the distance between the diaphragm 60 and the fixed electrode 72 in the acoustic transducer is about a few μm, and the diaphragm 60 is thin (typically, about 1 μm) and thus has a weak elastic force (restoring force). For this reason, when moisture enters the gap, the diaphragm 60 is adsorbed to the fixed electrode 72 by a capillary action, surface tension and the like of the moisture having entered, and even after evaporation of the moisture, the diaphragm 60 may not separate from the fixed electrode 72 by an intermolecular force, an interfacial force, and an electrostatic force that work between the diaphragm 60 and the fixed electrode 72.

Moreover, at driving of the acoustic transducer, a voltage is applied between the fixed electrode 72 and the diaphragm 60. When an external impact, an external force such as wind, or a large sound pressure acts on the diaphragm 60 in the state where the voltage is applied between the fixed electrode 72 and the diaphragm 60 and thus the diaphragm 60 is largely displaced to come in contact with the fixed electrode 72, short-circuit may occur to break the acoustic transducer.

The provision of the stoppers 74 can prevent a phenomenon that the diaphragm 60 does not separated from the fixed electrode 72 even after evaporation of moisture (the phenomenon that the diaphragm 60 adheres to the back plate 70) and can prevent short-circuit in the diaphragm 60 and the back plate 70 (fixed electrode 72). For this reason, the stoppers 74 are provided.

Note that, in the acoustic transducer shown in FIG. 15, a substrate 65, the diaphragm 60, and the back plate 70 are aligned in this order, and the stoppers 74 is provided on the back plate 70 side. However, there are also known the acoustic transducer having the substrate 65, the back plate 70, and the diaphragm 60 aligned in this order, and the acoustic transducer having the stoppers 74 provided on the diaphragm 60 side.

SUMMARY

As described above, the provision of the stoppers 74 can prevent adhesion of the diaphragm 60 to the back plate 70 and short-circuit in the diaphragm 60 and the back plate 70 (fixed electrode 72) at manufacturing and normal use of the acoustic transducer. However, with the existing acoustic transducer, the diaphragm 60 may adhere to the back plate 70 depending on use conditions.

Specifically, as described above, the acoustic transducer is used by applying a voltage between the diaphragm 60 and the back plate 70 (fixed electrode 72). For this reason, when some impact acts on the diaphragm 60 and thus the distance between the diaphragm 60 and the back plate 70 becomes small, resulting in that electrostatic attraction between the diaphragm 60 and the back plate 70 exceeds the elastic force (restoring force) of the diaphragm 60, a state where the diaphragm 60 is stuck on the back plate 70 by electrostatic attraction (hereinafter referred to as a pull-in state) is formed.

The pull-in state is solved by stopping application of a voltage between the diaphragm 60 and the back plate 70. However, with the existing acoustic transducer, when a voltage is continuously applied between the diaphragm 60 and the back plate 70 in the pull-in state for a long time (typically, a few days or more), the pull-in state may not be solved by stopping voltage application.

The above-mentioned phenomenon that the pull-in state is not solved by stopping voltage application (hereinafter referred to as a pull-in state continued phenomenon) may occur when a voltage is continuously applied between the diaphragm 60 and the fixed electrode 72 in the pull-in state for a long time. That is, the pull-in state continued phenomenon occurs only when uncommon loads act one after another on the acoustic transducer; however, the fact that the pull-in state continued phenomenon may occur is not ideal.

An acoustic transducer according to one or more embodiments of the present invention may be capable of suppressing the occurrence of the pull-in state continued phenomenon.

An acoustic transducer according to one or more embodiments of the present invention includes a back plate having a fixed electrode, a diaphragm that is opposed to the back plate with a gap interposed therebetween and that serves as a movable electrode, and a stopper protruding from a face of the back plate or the diaphragm, which is on a side of the gap, and the stopper includes a conductive section electrically isolated from the fixed electrode and the movable electrode and configured to come in contact with a front face of the fixed electrode or the movable electrode opposed to the stopper through deformation of the diaphragm.

That is, the pull-in state continued phenomenon is considered to occur in the existing acoustic transducer for a following reason.

When a voltage is continuously applied between the diaphragm (movable electrode) and the back plate (fixed electrode) in the existing acoustic transducer in the pull-in state for a long time, electrical charges are accumulated in the stopper serving as an insulator. Accumulation of the electrical charges in the stopper is stopped by stopping voltage application. However, the electrical charges once accumulated in the stopper are difficult to move in the stopper and difficult to move outside the stopper because the stopper is an insulator. For this reason, when the amount of electrical charges that generates electrostatic attraction exceeding the elastic force (restoring force) of the diaphragm is accumulated in the stopper by voltage application for a long time, the pull-in state continued phenomenon that the pull-in state is not solved by stopping voltage application occurs.

The pull-in state continued phenomenon is considered to occur for the above-mentioned reason (principle). An acoustic transducer according to one or more embodiments of the present invention includes a stopper protruding from a face of the back plate or the diaphragm, which is on a side of the gap, and the stopper includes a conductive section electrically isolated from the fixed electrode and the movable electrode and configured to come in contact with a front face of the fixed electrode or the movable electrode opposed to the stopper through deformation of the diaphragm.

A stopper of the acoustic transducer according to one or more embodiments of the present invention has a configuration where the electrical charges accumulated by voltage application between the diaphragm and the back plate move to the conductive section (to be accumulated in the conductive section). Then, the conductive section may be configured to come in contact with a front face of the fixed electrode or the movable electrode opposed to the stopper through deformation of the diaphragm (that is, comes in contact with the front face of the electrically conductive fixed electrode or movable electrode when the acoustic transducer is put into the pull-in state), and the moving speed of the electrical charge between electrically conductive members is extremely high. Therefore, an acoustic transducer according to one or more embodiments of the present invention may suppress the occurrence of the pull-in state continued phenomenon.

An acoustic transducer according to one or more embodiments of the present invention may be realized (manufactured) as a device in which a silicon substrate having a cavity formed therein, a back plate, and a diaphragm are aligned in this order, or may be realized as a device in which the silicon substrate having a cavity formed therein, the diaphragm, and the back plate are aligned in this order.

Moreover, the back plate having a fixed electrode in the acoustic transducer according to one or more embodiments of the present invention may be a conductive member that functions as a fixed electrode, or may be provided with a fixed electrode on a back face (a face that is not on the diaphragm side) or a front face of an insulating plate-like member. The diaphragm that serves as a movable electrode in an acoustic transducer according to one or more embodiments of the present invention may be a conductive member that functions as a movable electrode, or may be provided with a movable electrode on a back face (a face that is not on the back plate side) or a front face of the insulating plate-like member.

In an acoustic transducer according to one or more embodiments of the present invention, the conductive section includes a conductive film that covers at least a part of the stopper. In one or more embodiments of the present invention, the stopper is a member that protrudes from the face of the back plate, which is on the side of the gap, and that is electrically conductive also in a portion other than the conductive section.

In an acoustic transducer according to one or more embodiments of the present invention, the back plate or the diaphragm from which the stopper protrudes includes an electrically insulating plate-like section, and an electrode film provided on a face of the plate-like section, which is on the side of the gap, and serving as the fixed electrode or the movable electrode, and having an opening, the stopper protrudes from the plate-like section while having a portion that is not covered with the electrode film, and the conductive film of the stopper is provided in the opening of the electrode film. An acoustic transducer according to one or more embodiments of the present invention comprises a stopper protruding from a back plate, in which the back plate includes an electrically insulating plate-like section, and a fixed electrode provided on a face of the plate-like section, which is on the side of a gap, and having an opening, the stopper protrudes from the plate-like section while having a portion that is not covered with the fixed electrode, and a conductive film of the stopper is provided in the opening of the fixed electrode. An acoustic transducer according to one or more embodiments of the present invention comprises a stopper protruding from a diaphragm, in which the diaphragm includes an electrically insulating plate-like section, and a movable electrode provided on a face of the plate-like section, which is on the side of a gap, and having an opening, the stopper protrudes from the plate-like section while having a portion that is not covered with the movable electrode, and a conductive film of the stopper is provided in the opening of the movable electrode.

Moreover, in the case where the conductive film, or the electrode film serving as the fixed electrode or the movable electrode has a sharp corner, resistance to stress exerted during the manufacturing process after film formation, and resistance to falling after completion of manufacturing (hereinafter referred to as falling resistance and the like) lower. For this reason, according to one or more embodiments of the present invention, each conductive film of the acoustic transducer is formed to have a shape having no sharp corner on an outer edge thereof in a plan view. Moreover, according to one or more embodiments of the present invention, the electrode film of the acoustic transducer is formed to have a shape having no sharp corner on each edge thereof in a plan view.

In an acoustic transducer according to one or more embodiments of the present invention, the stopper protrudes from the back plate, and the conductive film has a shape falling within a polygon having, as vertices, centers of a plurality of sound holes that is adjacent to the stopper and that is provided in the back plate. Note that an acoustic transducer according to one or more embodiments of the present invention may prevent the area of the electrode film (fixed electrode) formed so as not to come in contact with the conductive film from being excessively small. Therefore, the acoustic transducer that has the same sensitivity as the existing acoustic transducer is acquired, or the acoustic transducer that has sensitivity which lowers in a relatively less amount by the provision of the conductive film is acquired.

In realizing an acoustic transducer according to one or more embodiments of the present invention, a way of isolating the electrode film (the fixed electrode or the movable electrode) from the conductive film (a method of separating the electrode film from the conductive film) is not particularly limited. For example, an acoustic transducer of a type having the stopper protruding from the back plate may be realized (manufactured) in such a manner that the conductive film and the electrode film (fixed electrode) each have a shape that does not include the sound holes in an insulating section configured to isolate the conductive film from the electrode film, or may be realized in such a manner that the conductive film is isolated from the electrode film (fixed electrode) by an insulating section passing through a plurality of sound holes provided in the back plate.

In realizing an acoustic transducer according to one or more embodiments of the present invention, a plurality of conductive films can be formed by a process that is different from a formation process of the electrode film (the fixed electrode or the movable electrode). However, according to one or more embodiments of the present invention, in the case where the electrode film and the conductive film are provided on the same face, the electrode film and the plurality of conductive films are formed by separating the conductive member formed by the same process (one process or a series of processes), in order that the acoustic transducer can be manufactured by essentially the same manufacturing process as that of the existing acoustic transducer. In other words, in manufacturing an acoustic transducer in which the fixed electrode and the plurality of conductive films are provided on a face of the plate-like section, which is on the side opposed to the diaphragm, one or more embodiments of the present invention employs a manufacturing procedure of forming a conductive member, and separating (patterning) the formed conductive member to form the fixed electrode and the plurality of conductive films, in order that the acoustic transducer can be manufactured by essentially the same manufacturing process as that of the existing acoustic transducer.

The conductive film only needs to cover at least a part of the stopper; however, a larger contact area between the conductive film and the diaphragm (or the back plate) can prevent breakage due to the concentration of stress on the diaphragm when the diaphragm collides with the stopper (or when the stopper collides with the back plate). Moreover, electrical charges accumulated in the stopper tend to move to the diaphragm (or the back plate). For this reason, according to one or more embodiments of the present invention, each conductive film has a shape that covers a top of the stopper.

Moreover, in realizing an acoustic transducer according to one or more embodiments of the present invention, a minimum distance between the conductive film and the electrode film can be set to a distance larger than a value acquired by dividing a dielectric withstand voltage of a material for the plate-like section by a voltage applied between the fixed electrode and the diaphragm at detection of a vibration amount of the diaphragm.

An acoustic transducer according to one or more embodiments of the present invention may include an electrically insulating second stopper protruding from the face of the back plate or the diaphragm, which is on the side of the gap and from which the stopper protrudes, or as the acoustic transducer in which the second stopper is provided in an outer region of a region of the plate-like section where the electrode film is provided.

In an acoustic transducer according to one or more embodiments of the present invention, the back plate or the diaphragm from which the stopper protrudes includes an electrode film having an opening, and the stopper protrudes from the opening of the electrode film. In an acoustic transducer according to one or more embodiments of the present invention, the back plate or the diaphragm from which the stopper protrudes includes an electrically insulating plate-like section, and an electrode film provided on a face of the plate-like section, which is on a side different from the side of the gap. In an acoustic transducer according to one or more embodiments of the present invention, the back plate or the diaphragm from which the stopper protrudes is a member made of a conductive material.

According to one or more embodiments of the present invention, an acoustic transducer capable of suppressing the occurrence of the pull-in state continued phenomenon can be provided.

DETAILED DESCRIPTION

Embodiments of the present invention will be described below with reference to the appended drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. Additionally, the present invention is not limited to the following embodiments, and may be variously changed/modified without deviating from the spirit of the present invention.

Figure 1:
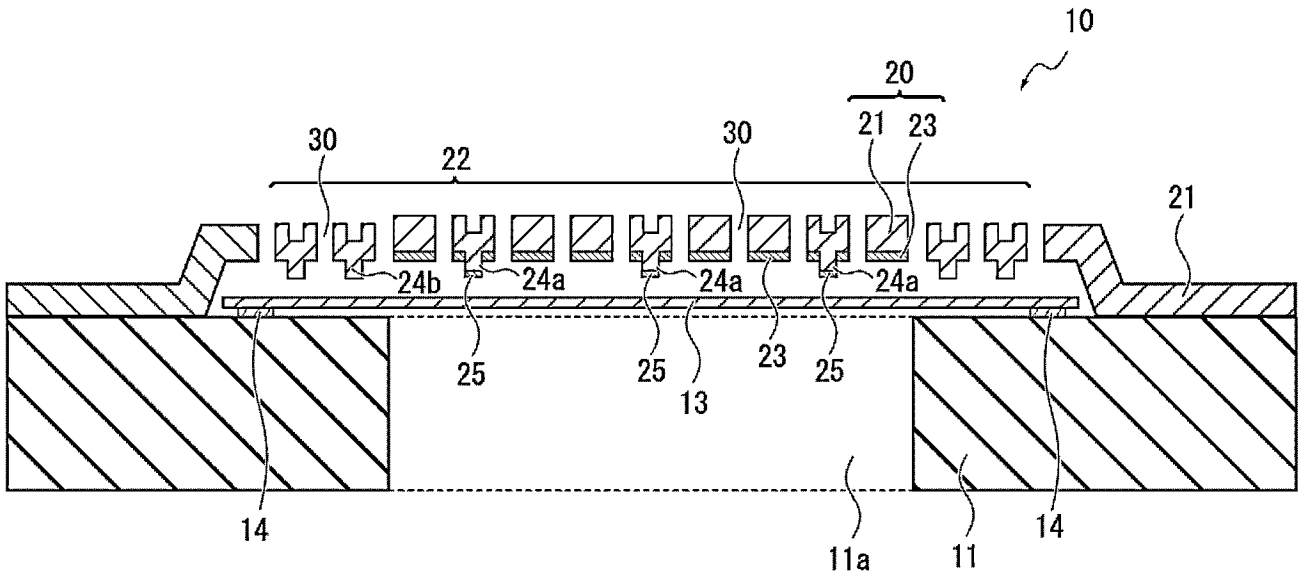
FIG. 1 is a schematic sectional view of an acoustic transducer in accordance with one or more embodiments of the present invention.
Figure 2:
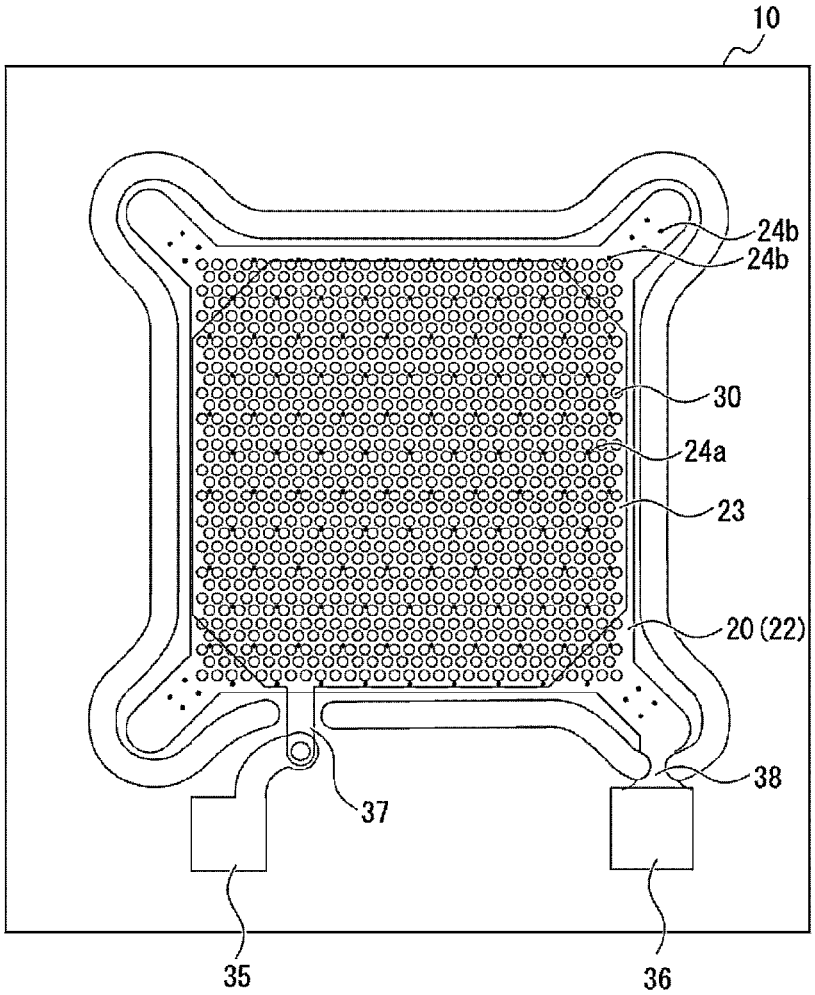
FIG. 2 is a top view of the acoustic transducer in accordance with one or more embodiments of the present invention.
Figure 3:
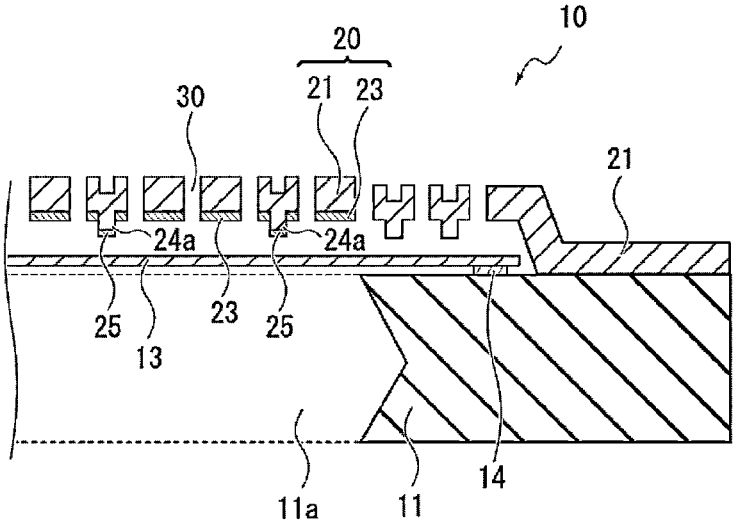
FIG. 3 is a view illustrating an example of a shape of a cavity of a silicon substrate.

First, referring to FIG. 1 to FIG. 3, a basic configuration of an acoustic transducer 10 in accordance with one or more embodiments of the present invention will be described. Note that, in the below-mentioned acoustic transducer 10, a portion including stoppers 24*a* and conductive films 25 corresponds to a stopper of one or more embodiments of the present invention, and the conductive films 25 correspond to a conductive section of one or more embodiments of the present invention. Moreover, in the acoustic transducer 10, an electrode support 22 corresponds to a plate-like section of one or more embodiments of the present invention, and stoppers 24*b* correspond to a second stopper of one or more embodiments of the present invention. Moreover, FIG. 1 and FIG. 2 are a schematic sectional view and a top view of the acoustic transducer 10, respectively. However, in the top view of FIG. 2, actually invisible lines are represented by solid lines. FIG. 3 is a view illustrating an example of a shape of a cavity 11*a* of a silicon substrate 11.

An acoustic transducer 10 in accordance with one or more embodiments of the present invention is a capacitor acoustic transducer manufactured by using MEMS (Micro Electro Mechanical Systems). As shown in FIG. 1, the acoustic transducer 10 includes the silicon substrate 11 having the cavity 11*a* formed therein, a diaphragm 13, and a back plate 20. Moreover, as shown in FIG. 2, a fixed electrode pad 35 and a movable electrode pad 36 between which a voltage is applied at use of the acoustic transducer 10 are provided on an upper face (a face on the back plate 20 side) of the acoustic transducer 10. Then, the fixed electrode pad 35 is connected to a fixed electrode 23 (which is described later in detail) of the back plate 20 via extraction wiring 37, and the movable electrode pad 36 is connected to the diaphragm 13 not shown in FIG. 2 (see FIG. 1) via extraction wiring 38.

The cavity 11*a* formed in the silicon substrate 11 (FIG. 1) is a portion that functions as a back chamber. Although the cavity 11*a* shown in FIG. 1 has side faces parallel to the thickness direction of the silicon substrate 11, the cavity 11*a* may have other shapes, for example, a shape having inclined surfaces on the side faces. Moreover, as schematically shown in FIG. 3, the silicon substrate 11 may be provided with the cavity 11*a* having a wall face bent into a doglegged manner.

The diaphragm 13 (FIG. 1) is an electrically conductive thin film (typically, a polysilicon thin film) that functions as a movable electrode (vibration electrode). An outer circumference of the diaphragm 13 is fixed to an upper face of the silicon substrate 11 via a plurality of anchors 14. Note that, as a constituent material for the anchors 14, $SiO_2$ is typically used.

The back plate 20 is a member that includes a plate 21 and the fixed electrode 23 as the main components.

The plate 21 is a dome-shaped (cap-shaped) member made of an insulating material (typically, $Si_3N_4$). The plate-like electrode support 22 is provided in a center portion of the plate 21, and the plate 21 has a shape in which the electrode support 22 is opposed to the diaphragm 13 with a gap interposed therebetween at a predetermined distance (typically, a few μm).

The fixed electrode 23 is a continuous film made of a conductive material (typically, polysilicon), which is located on the lower face (a face on the diaphragm 13 side) side of the electrode support 22. As shown in FIG. 1 and FIG. 2, the size of the fixed electrode 23 is smaller than the size of the electrode support 22. Therefore, a portion (region) that is not covered with the fixed electrode 23 is present on the lower face of the electrode support 22.

Moreover, as shown in FIG. 1 and FIG. 2, a plurality of sound holes 30 through which acoustic vibration passes is formed in the back plate 20. More specifically, the sound holes 30 through which acoustic vibration passes and which penetrate only the electrode support 22 are formed in the portion that is present in the electrode support 22 of the back plate 20 and that is not covered with the fixed electrode 23. Moreover, the sound holes 30 through which acoustic vibration passes and which penetrate both the electrode support 22 and the fixed electrode 23 are formed in a portion that is present in the electrode support 22 of the back plate 20 and that is covered with the fixed electrode 23. Note that, although FIG. 2 shows the back plate 20 (electrode support 22) in which the sound holes 30 are aligned in a triangular shape along three directions making an angle of 120° with each other, the arrangement pattern of the sound holes 30 is not limited thereto. For example, the sound holes 30 can be arranged in a gridlike manner or in a concentric circular.

As shown in FIG. 1, a plurality of stoppers 24 (24*a* and 24*b*) made of an insulating material (a constituent material for the plate 21) protrudes from the lower face of the electrode support 22 of the back plate 20. The stoppers 24 include the stoppers 24*a* protruding from the portion that is present on the lower face of the electrode support 22 and that is covered with the fixed electrode 23, and the stoppers 24*b* protruding from the portion that is present on the lower face of the electrode support 22 and that is not covered with the fixed electrode 23. Then, an acoustic transducer 10 in accordance with one or more embodiments of the present invention has, as shown in FIG. 1, a configuration in which a top of each stopper 24*a* (a portion opposed to the diaphragm 13) is covered with each conductive film 25 electrically isolated from the fixed electrode 23.

A configuration of the acoustic transducer 10 will be further specifically described below.

First, referring to FIGS. 4(A) to 4(D), a manufacturing procedure of the acoustic transducer 10 shown in FIG. 1 will be briefly described.

At manufacturing of the acoustic transducer 10 shown in FIG. 1, first, a sacrifice layer 51 is formed on the silicon substrate 11 provided with no cavity 11*a*. Next, the diaphragm 13 is formed on the sacrifice layer 51 and then, a sacrifice layer 52 is formed on the sacrifice layer 51 and the diaphragm 13 (FIG. 4(A)).

Figure 4A:
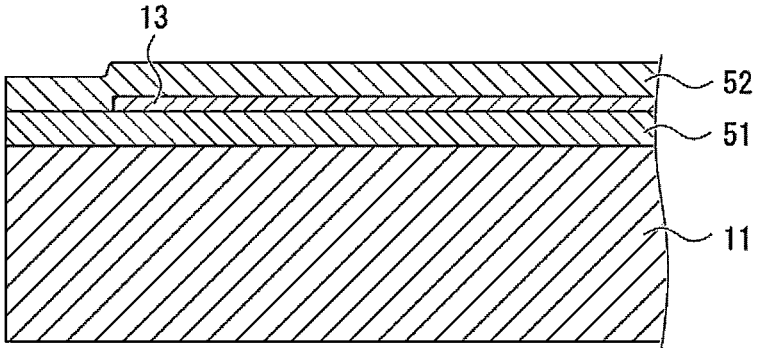
FIGS. 4(A) to 4(D) are views illustrating a manufacturing procedure of the acoustic transducer in accordance with one or more embodiments of the present invention.
Figure 4B:
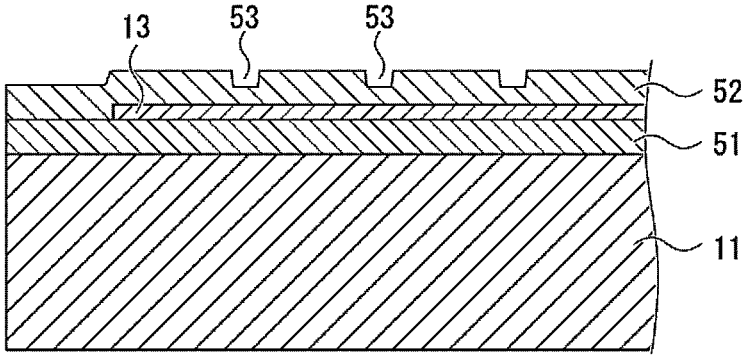
Figure 4C:
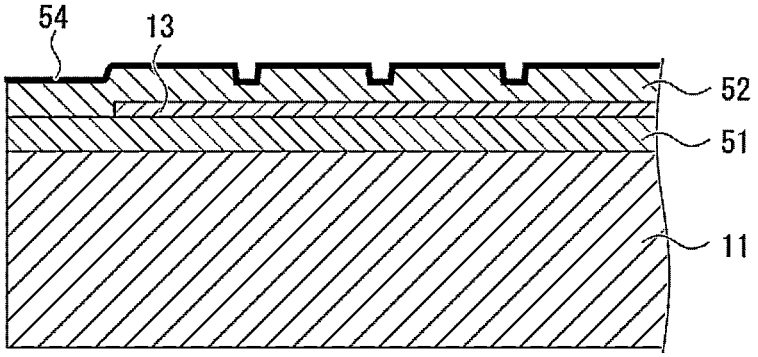

Subsequently, recesses 53 are formed in portions which are present on an upper face of the sacrifice layer 52 and in which the stoppers 24 are to be formed (FIG. 4(B)). Next, a conductive material layer 54 is formed on the sacrifice layer 52 having the plurality of recesses 53 formed therein (FIG. 4(C)). Then, an unnecessary portion is removed from the conductive material layer 54 to form the fixed electrode 23 and the plurality of conductive films 25 (FIG. 4(D)). Note that the fixed electrode 23 formed at this time has open portions that become the sound holes 30.

Figure 4D:
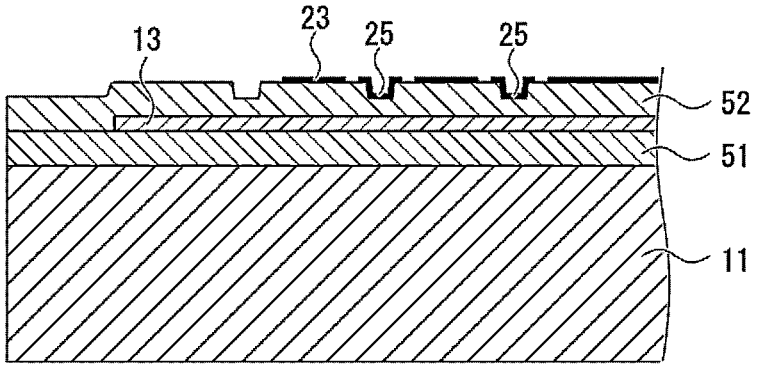

Following acquisition of the structure (laminate) shown in FIG. 4(D), an insulating material (typically, $Si_3N_4$) is stacked on the sacrifice layer 52 having the plurality of conductive films 25 and the fixed electrode 23 formed thereon to form the plurality of stoppers 24 and the plate 21 (provided with no sound hole 30).

Subsequently, for example, a process of forming the sound holes 30, a process of forming the cavity 11*a* in the silicon substrate 11, and a process of removing the sacrifice layers 51 and 52 while leaving portions that become the anchors 14 are performed to manufacture the acoustic transducer 10.

Next, the stoppers 24, the fixed electrode 23, and the conductive films 25 in the acoustic transducer 10 will be described below. Note that, in the following description, the portions removed from the conductive material layer 54 to form the fixed electrode 23 and the plurality of conductive films 25 (see FIG. 4(D)) are referred to as a separation border.

Moreover, a portion that is present between the fixed electrode 23 and each conductive film 25 in the completed acoustic transducer 10 and that is filled with an insulator (the constituent material for the plate 21 or air) is referred to as a border section (corresponding to an insulating section of one or more embodiments of the present invention).

FIGS. 5(A) to 5(E) are plan views of the back plates 20 having different configurations (are different in an arrangement pattern of the sound holes 30 and the like) when viewed from the diaphragm 13 side. Note that portions represented in dark gray in FIGS. 5(A) to 5(E) are the portions filled with the constituent material for the plate 21 (the border section or a part of the border section).

Although various arrangement patterns of the sound holes 30 can be employed as described above, a position of the stopper 24*a* is typically is set to the center of three or more adjacent sound holes 30 among the sound holes 30 regularly aligned in a certain pattern, as shown in FIG. 5(A) to FIG. 5(D). However, the position of the stopper 24*a* is not necessarily set to such a position. For example, in the case where a region where the stopper 24 of desired size can be formed cannot be secured at the center of the plurality of adjacent sound holes 30 because of the sound holes 30 are too close to one another, the stopper 24*a* may be formed at a location where the sound hole 30 has to be formed because of a regular pattern, as shown in FIG. 5(E).

Note that the stoppers 24*b* can be formed at the same positions as the stoppers 24*a* and positions away from the sound holes 30 (see FIG. 2). Moreover, the stoppers 24*b* may be formed in the portion that is present on the lower face of the electrode support 22 and that is covered with the fixed electrode 23. In other words, both the stoppers 24 having the conductive films 25 provided at the tops thereof and the stoppers 24 having no conductive film 25 provided at the tops thereof may be present on the portion that is present on the lower face of the electrode support 22 and that is covered with the fixed electrode 23.

The shape of the conductive film 25 only needs to be a shape that covers at least a part of the top of the stopper 24*a*; however, as a contact area between the conductive film 25 and the diaphragm 13 is larger, electrical charges accumulated in the stoppers 24*a* (which is described later in detail) become easier to move to the diaphragm 13 side. For this reason, according to one or more embodiments of the present invention, the shape of the conductive film 25 is a shape that covers the top of the stopper 24*a*.

However, as the area of the conductive film 25 becomes larger, the area of the fixed electrode 23 decreases. Then, since the decrease in the area of the fixed electrode 23 lowers the sensitivity of the acoustic transducer 10, according to one or more embodiments of the present invention, the shape of the conductive film 25 is set to a shape that does not excessively decrease the area of the fixed electrode 23, that is, a shape that falls within a polygon having, as vertices, the centers of the plurality of sound holes 30 adjacent to the stopper 24*a* as shown in FIGS. 5(A) to 5(E). Moreover, according to one or more embodiments of the present invention, the shape of the conductive film 25 is set to a shape slightly larger than that of the stopper 24*a* (FIGS. 5(A), 5(C), and 5(F)) or a shape that covers only the top or the top and its neighborhood of the stopper 24*a* as schematically shown in FIGS. 6(A) and 6(B).

Figure 5A:
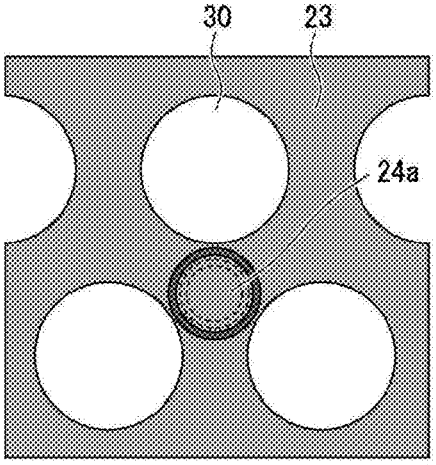
FIGS. 5(A) to 5(E) are views illustrating configurations of back plates having different configurations when viewed from the diaphragm side.
Figure 5B:
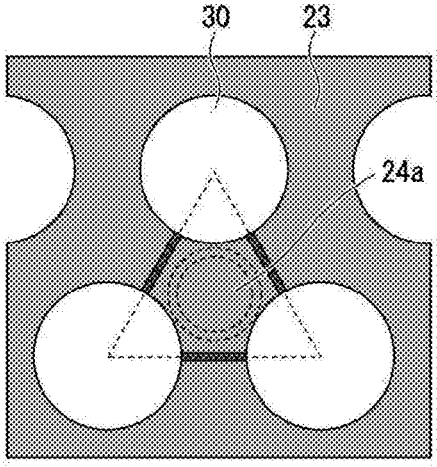
Figure 5C:
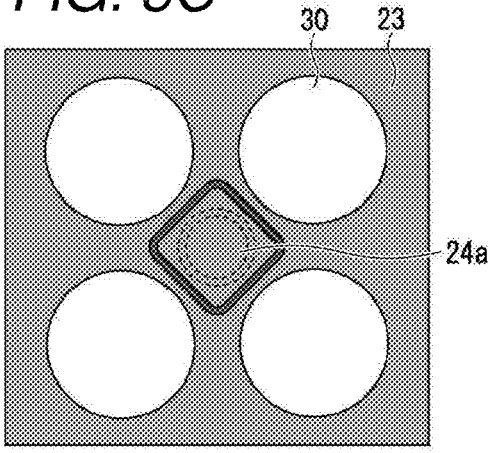
Figure 5D:
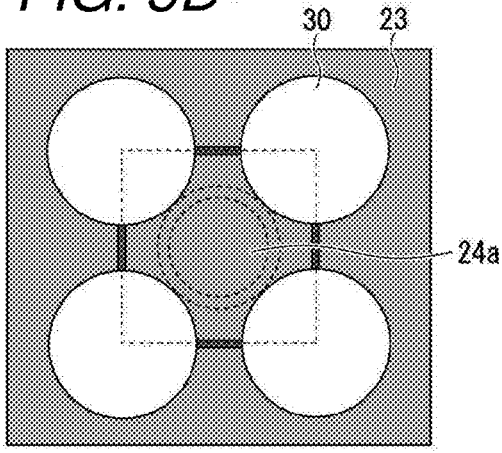
Figure 5E:
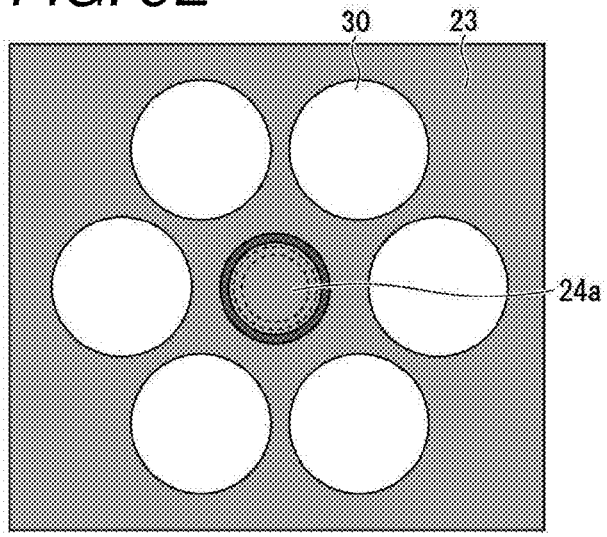
Figure 6A:
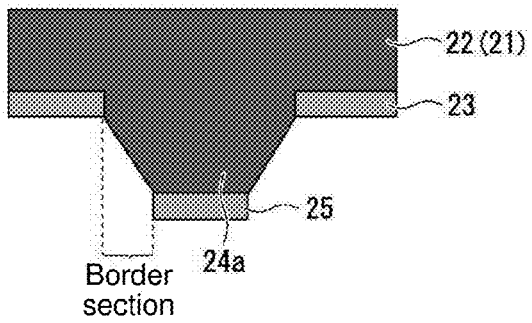
FIGS. 6(A) to 6(C) are views illustrating examples of shapes of a conductive film and a border section.
Figure 6B:
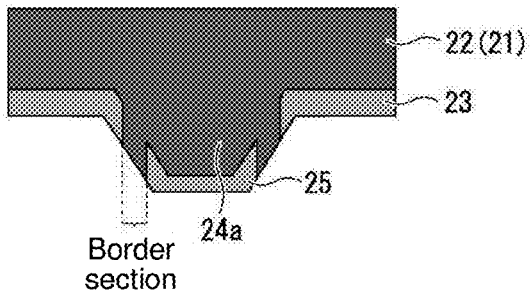
Figure 6C:
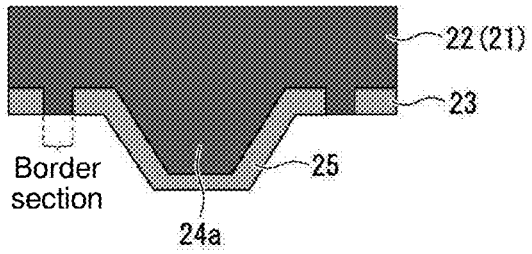

However, it is difficult to precisely provide the border section on the wall face of the stopper 24*a* (see FIGS. 6(A) and 6(B)). Therefore, according to one or more embodiments of the present invention, as shown in FIG. 6(C) (and FIGS. 5(A) to 5(F)), the border section is provided in a portion having the same height as that of the fixed electrode 23.

Figure 7:
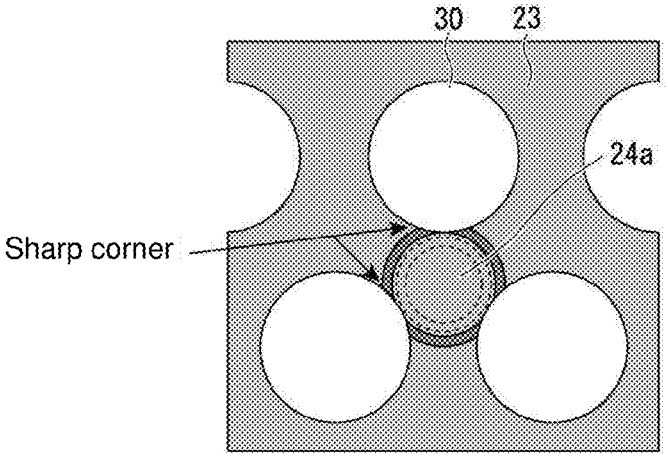
FIG. 7 is a view illustrating an example of a shape of the border section.

Moreover, in the case where an outer edge of the conductive film 25 has a sharp corner, stress tends to concentrate on the corner and thus, resistance to stress exerted during the manufacturing process after film formation, and resistance to falling after completion of manufacturing (hereinafter referred to as falling resistance and the like) lower as compared to the case where the outer edge of the conductive film 25 has no sharp corner. Similarly, in the case where each edge of the fixed electrode 23 (an outer edge, an edge of each opening) has a sharp corner, the falling resistance and the like lower as compared to the case where any edge of the fixed electrode 23 has no sharp corner. For this reason, according to one or more embodiments of the present invention, each conductive film 25 and each edge of the fixed electrode 23 have no sharp corner. However, when the separation border is provided around the stopper 24*a* with small distances from the sound holes 30, the separation border crosses the sound holes 30, resulting in that a sharp corner is formed at each point of the fixed electrode 23 as schematically shown in FIG. 7.

On the other hand, as shown in FIGS. 5(B) and 5(D), when a portion including a linear portion located on a line passing through the centers of two of the plurality of sound holes 30 adjacent to the stopper 24*a* and the plurality of sound holes 30 is set to become the separation border, each conductive film 25 and each edge of the fixed electrode 23 can be prevented from having an excessively sharp corner. Therefore, giving a high priority to the prevention of a low falling resistance and the like, the shapes of each conductive film 25 and the fixed electrode 23 (the shape of the separation border between each conductive film 25 and the fixed electrode 23) may be set to the shapes as shown in FIGS. 5(B) and 5(D).

Figure 8:
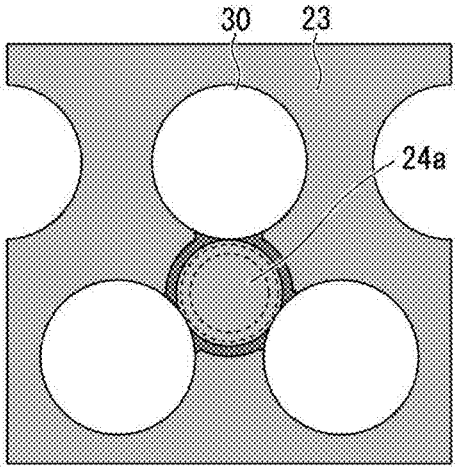
FIG. 8 is a view illustrating an example of a shape of the border section.

Moreover, in place of setting the shape of the separation border to the shape as shown in FIG. 5(B), the fixed electrode 23 can be patterned into a shape having no sharp corner as shown in FIG. 8. Note that, when this configuration shown in FIG. 8 is employed, the area of the fixed electrode 23 becomes larger than that in the case where the shape of the separation border is set to the shape as shown in FIG. 5(B). Therefore, when the configuration shown in FIG. 8 is employed, the acoustic transducer 10 with a higher sensitivity can be acquired as compared to the acoustic transducer 10 in which the shape of the separation border is set to the shape as shown in FIG. 5(B).

When any of the above-mentioned configurations is employed, a minimum width of each border section (a minimum distance between the fixed electrode 23 and each conductive film 25) is defined such that dielectric breakdown does not occur in the insulator (the constituent material for the plate 21 or air) in each border section at use of the acoustic transducer 10.

Specifically, for example, when the dielectric withstand voltage of the constituent material for the plate 21 (for example, $Si_3N_4$) is about 3.7 MV/cm, and the voltage applied between the diaphragm 13 and the fixed electrode 23 at use of the acoustic transducer 10 is 15 V, the minimum width of each border section has to be larger than 3.7 MV/cm=15 V=41 nm.

Then, the width of the border section also varies depending on variation in the manufacturing process. Therefore, the minimum distance of the border section between the fixed electrode 23 and each stopper 24*a* is desirably defined in consideration of the above-mentioned distance determined from the dielectric withstand voltage and the like, and an amount of the change of the width of the border section depending on the variation in the manufacturing process. However, in ordinary cases (in the case where a material having an extremely low dielectric withstand voltage is not used as the constituent material for the plate 21, and a manufacturing process having an extremely poor precision is not used), the minimum width of each border section only needs to be set to a value of 1 μm or more.

Various experiments have confirmed that the acoustic transducer 10 employing the above-mentioned configuration (the configuration where the conductive film 25 is provided at the top of each stopper 24*a*) can suppress the occurrence of the pull-in state continued phenomenon that the pull-in state is not solved by stopping voltage application (the pull-in state is solved by stopping voltage application). For this reason, the reasons why the pull-in state continued phenomenon may occur in the conventional acoustic transducer and does not occur in the acoustic transducer 10 are considered as follows.

Figures 9A, 9B, 9C:
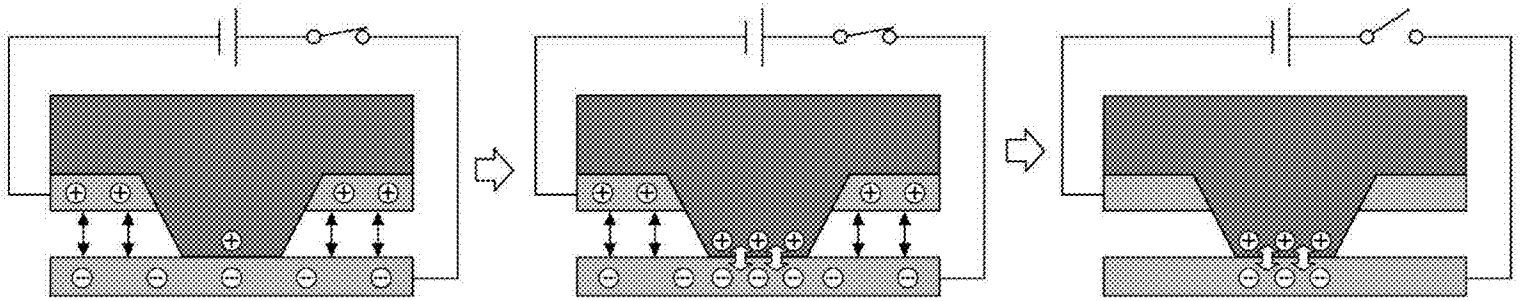
FIGS. 9(A) to 9(C) are views illustrating a cause of occurrence of a pull-in state continued phenomenon in an existing acoustic transducer.

First, referring to FIGS. 9(A) to 9(C), the reason why the pull-in state continued phenomenon occurs in the conventional acoustic transducer will be described.

The following case will be considered: some impact acts on the diaphragm of the conventional acoustic transducer, and thus the distance between the diaphragm and the back plate becomes small, resulting in that electrostatic attraction between the diaphragm and the back plate exceeds the elastic force of the diaphragm. In this case, as shown in FIG. 9(A), the pull-in state is formed. Then, when a voltage is continuously applied between the diaphragm and the back plate in the pull-in state, electrical charges are accumulated in the stopper. The speed at which electrical charges are accumulated in the stopper serving as an insulator is very slow, but when a voltage is continuously applied between the diaphragm and the back plate for a long time, a large amount of electrical charges is accumulated in the stopper as schematically shown in FIG. 9(B).

Then, the electrical charges once accumulated in the stopper are difficult to move. For this reason, even when application of the voltage between the diaphragm and the back plate is stopped in the state shown in FIG. 9(B), the pull-in state becomes sustained by electrostatic attraction due to the electrical charges accumulated in the stopper as shown in FIG. 9(C) (the pull-in state is not solved).

Next, referring to FIGS. 10(A) to 10(D), the reason why when the configuration of the acoustic transducer 10 is employed, the occurrence of the pull-in state continued phenomenon can be suppressed will be described below.

Figures 10A, 10B, 10C, 10D:
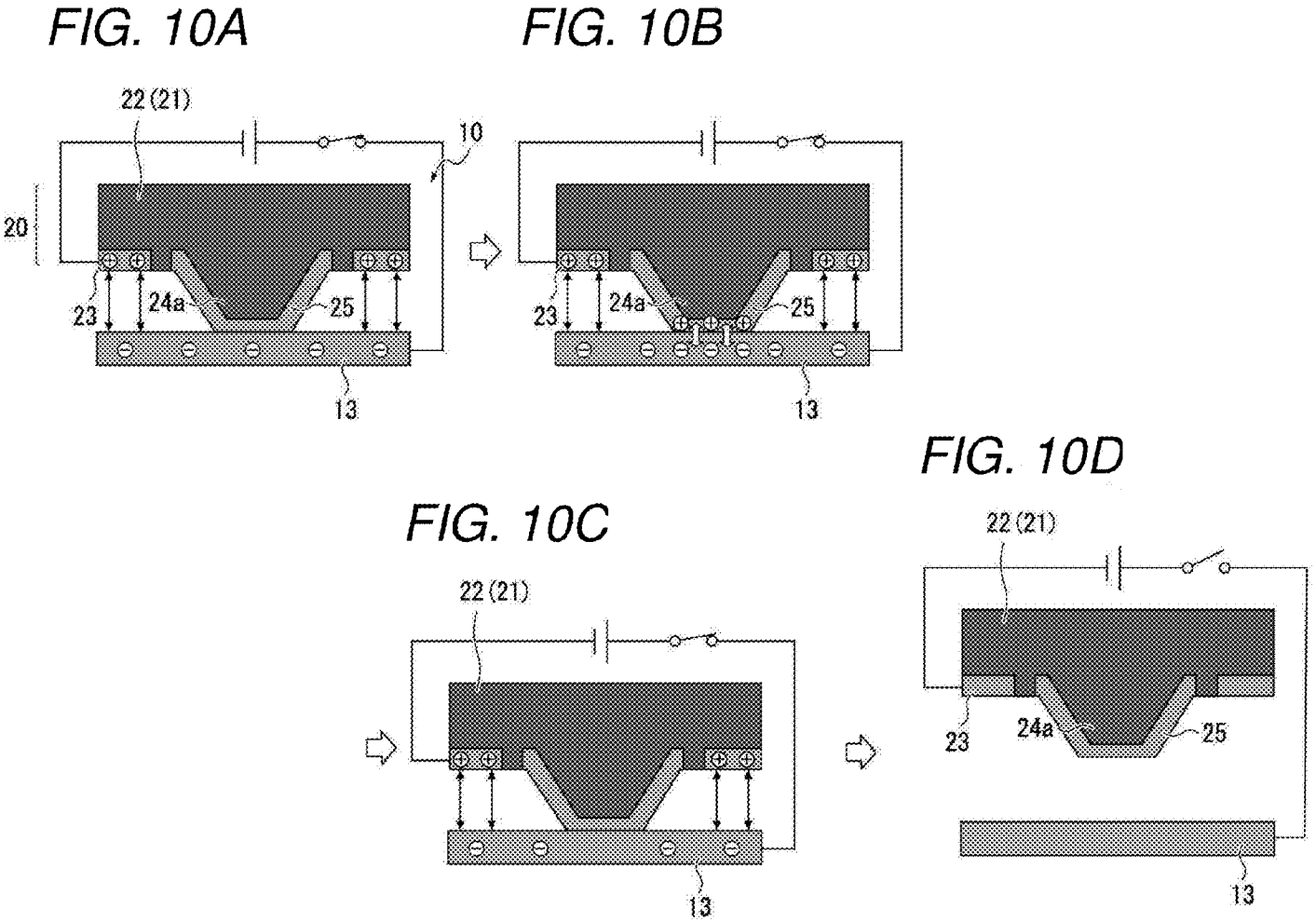
FIGS. 10(A) to 10(D) are views illustrating a reason why the pull-in state continued phenomenon does not occur in the acoustic transducer in accordance with one or more embodiments of the present invention.

As shown in FIG. 10(A), the acoustic transducer 10 may be put into the pull-in state. Even in the acoustic transducer 10, when a voltage is continuously applied between the diaphragm 13 and the fixed electrode 23 in the pull-in state as shown in FIG. 10(B), electrical charges are accumulated in the stopper 24*a* serving as an insulator. However, since the conductive film 25 is present on the top of the stopper 24*a*, electrical charges on the diaphragm 13 side offset the electrical charges accumulated in the stopper 24*a* within a short time (FIG. 10(C)). Therefore, in the acoustic transducer 10, even when the voltage is continuously applied between the diaphragm 13 and the fixed electrode 23 in the pull-in state for a long time, a large amount of electrical charges is not accumulated in the stopper 24*a*.

For this reason, with the acoustic transducer 10, the pull-in state is solved by stopping voltage application.

<<Modification>>

The above-mentioned acoustic transducer 10 may be variously modified. Specifically, the phenomenon that the pull-in state is not solved by stopping voltage application is a phenomenon that can occur, although there is a difference in the extent depending on the actual configuration, in any acoustic transducer having the stopper provided in the diaphragm or the back plate.

Figure 11A:
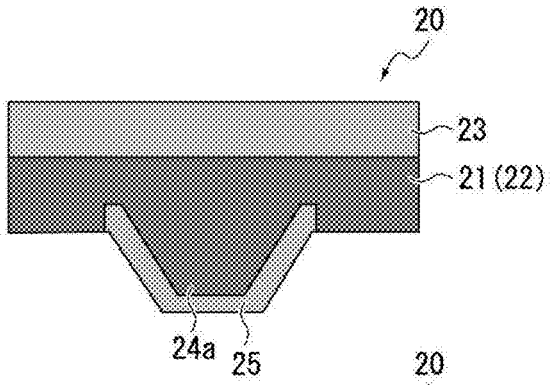
FIGS. 11(A) to 11(D) are views illustrating modifications of the acoustic transducer in accordance with one or more embodiments of the present invention.
Figure 11B:
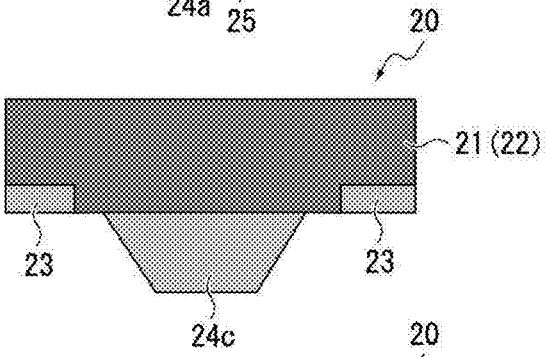

Therefore, the back plate 20 of the acoustic transducer 10 can be modified to a back plate 20 having a configuration shown in FIG. 11(A), that is, the back plate 20 having a fixed electrode 23 provided on a face of a plate 21, which is on the side not opposed to a diaphragm 13. Moreover, the back plate 20 can be modified to a back plate 20 having a configuration shown in FIG. 11(B), that is, the back plate 20 provided with a conductive stopper 24*c* in place of the non-conductive stopper 24*a* and the conductive film 25.

Figure 11C:
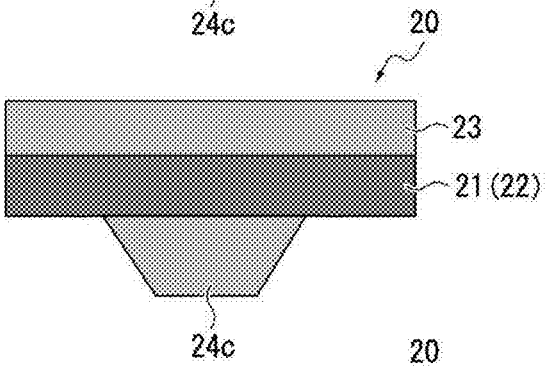
Figure 11D:
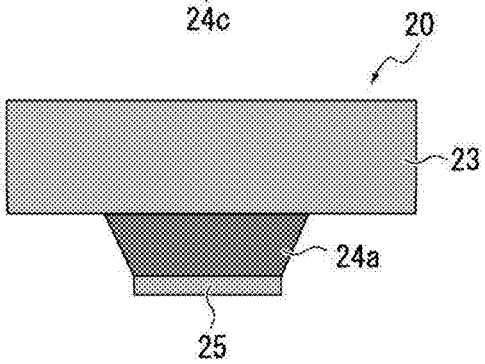

Moreover, the back plate 20 can be modified to a back plate 20 having a configuration shown in FIG. 11(C), that is, the back plate 20 that has a fixed electrode 23 provided on a face of a plate 21, which is on the side not opposed to a diaphragm 13 and that is provided with a conductive stopper 24*c* in place of the non-conductive stopper 24*a* and the conductive film 25. Further, the back plate 20 can be modified to a back plate 20 having a configuration shown in FIG. 11(D), that is, the back plate 20 having no insulating member corresponding to the plate 21 present in a center portion thereof (a portion where the stopper 24*a* and the conductive film 25 are provided).

Figure 12:
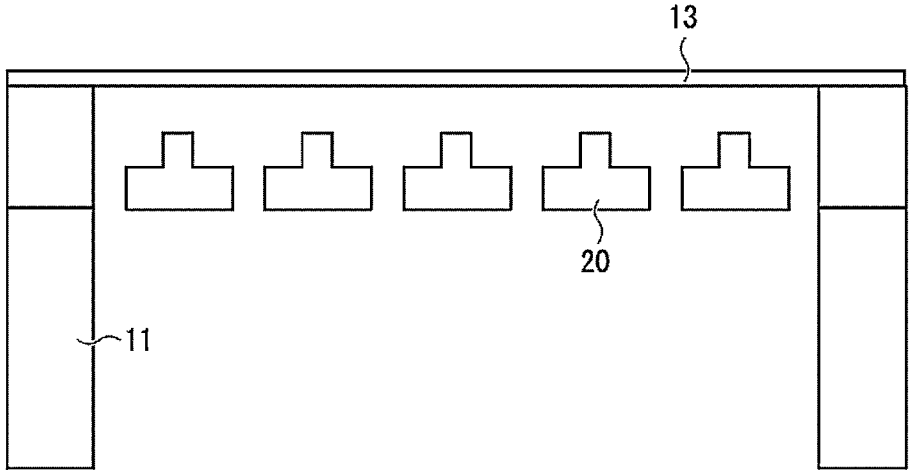
FIG. 12 is a view illustrating a modification of the acoustic transducer in accordance with one or more embodiments of the present invention.

Moreover, as schematically shown in FIG. 12, the acoustic transducer 10 can be modified to an acoustic transducer in which the silicon substrate 11, the back plate 20 as shown in FIGS. 6(A) to 6(C) and FIGS. 11(A) to 11(D), and the diaphragm 13 are aligned in this order. In this case, the stoppers 24*a* and the conductive films 25 only need to be used so as to protrude toward the diaphragm 13.

The acoustic transducer 10 can also be modified to an acoustic transducer in which a diaphragm 13 is provided with a stopper 24*a*, a conductive film 25, and a stopper 24*c*.

Figure 13A:
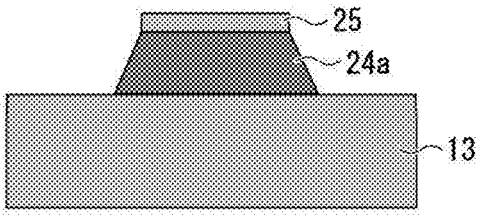
FIGS. 13(A) to 13(E) are views illustrating modifications of the acoustic transducer in accordance with one or more embodiments of the present invention.

Specifically, as shown in FIG. 13(A), the stopper 24*a* and the conductive film 25 can be provided on a face of the diaphragm 13 of the acoustic transducer 10, which is on the side opposed to a back plate 20. Note that, in the description on FIGS. 13(A) to 13(E), the face on the side opposed to the back plate 20 is a face on the upper side in each of FIGS. 13(A) to 13(E).

Figure 13B:
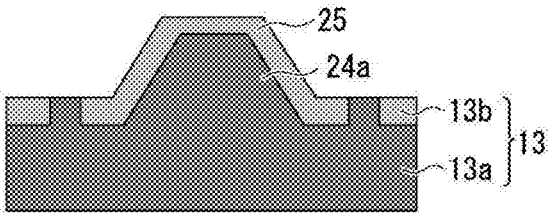

As shown in FIG. 13(B), the acoustic transducer 10 can also employ the diaphragm 13 provided with a movable electrode 13*b* and a plurality of sets of (one set in FIG. 13(B)) the stoppers 24*a* and the conductive films 25 on a face of a support 13*a* made of an insulating material, which is on the side opposed to the back plate 20, such that each conductive film 25 is electrically isolated from other conductive members (the movable electrode 13*b* and the like).

Figure 13C:
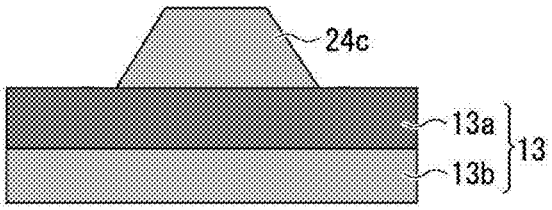
Figure 13D:
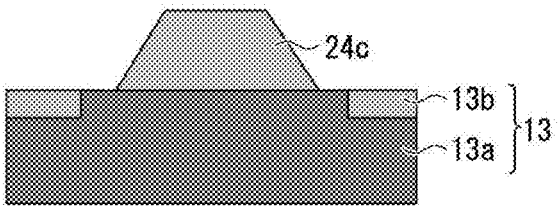

As shown in FIG. 13(C), the acoustic transducer 10 can employ the diaphragm 13 provided with the movable electrode 13*b* on a face of the support 13*a* made of an insulating material, which is on the side not opposed to the back plate 20, and then can also have a plurality of stoppers 24*c* (electrically conductive stoppers) provided on a face of the support 13*a* of the diaphragm 13, which is on the side opposed to the back plate 20. Moreover, as shown in FIG. 13(D), the acoustic transducer 10 can also employ the diaphragm 13 provided with the movable electrode 13*b* and a plurality of sets of the stoppers 24*c* on a face of the support 13*a* made of an insulating material, which is on the side opposed to the back plate 20, such that each stopper 24*c* is electrically isolated from other conductive members.

Figure 13E:
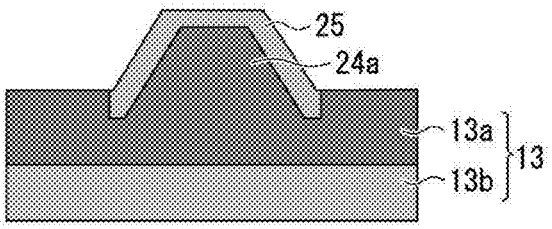

As shown in FIG. 13(E), the acoustic transducer 10 can employ the diaphragm 13 provided with the movable electrode 13*b* on a face of the support 13*a* made of an insulating material, which is on the side not opposed to the back plate 20, and then can also have a plurality of sets of the stoppers 24*a* and the conductive films 25 provided on a face of the support 13*a* of the diaphragm 13, which is on the side opposed to the back plate 20.

Figure 14A:
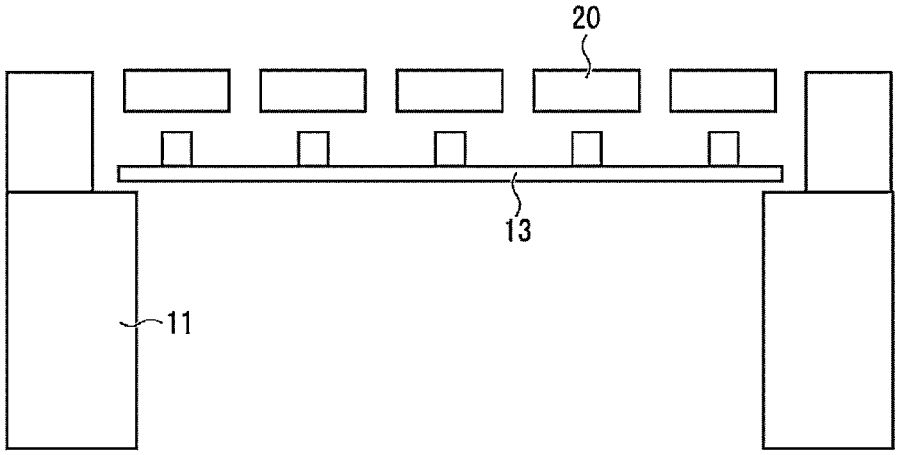
FIGS. 14(A) and 14(B) are views illustrating modifications of the acoustic transducer in accordance with one or more embodiments of the present invention.
Figure 14B:
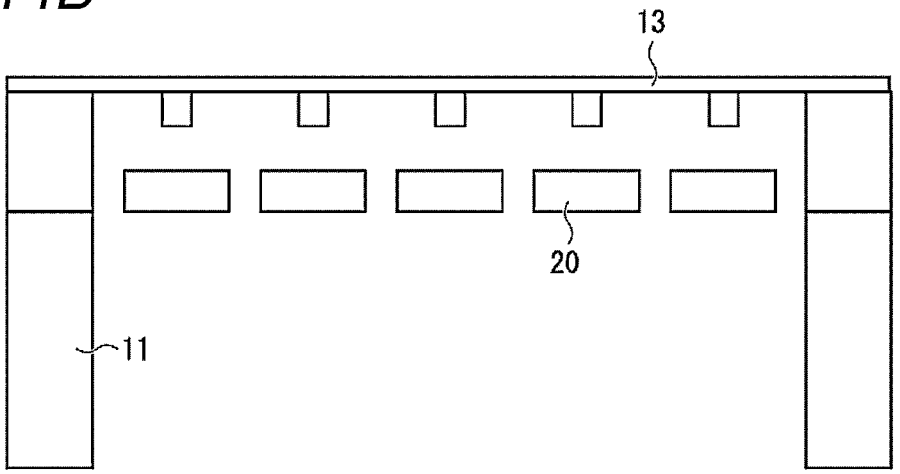
Figure 15:
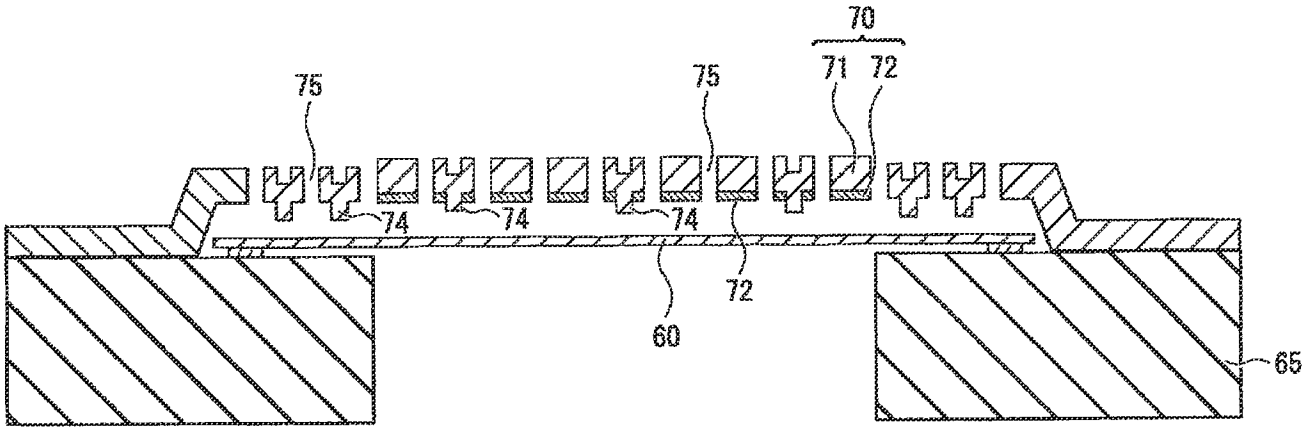
FIG. 15 Prior Art
FIG. 15 is a view illustrating a configuration of an existing acoustic transducer.

Note that the diaphragm 13 as mentioned above only needs to be used in such a manner that the stoppers 24*a*, 24*b* protrude toward the back plate 20. Therefore, as schematically shown in FIGS. 14(A) and 14(B), the acoustic transducer 10 using the diaphragm 13 as mentioned above can be realized (manufactured) to have the silicon substrate 11, the diaphragm 13, and the back plate 20 aligned in this order (FIG. 14(A)) or to have the silicon substrate 11, the back plate 20, and the diaphragm 13 aligned in this order (FIG. 14(B)).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. An acoustic transducer comprising:

a back plate comprising a fixed electrode;

a diaphragm that is opposed to the back plate with a gap interposed therebetween and that serves as a movable electrode; and a stopper protruding from a face of the back plate or the diaphragm, which is on a side of the gap, wherein the stopper includes a conductive section electrically isolated from the fixed electrode and the movable electrode, and wherein the conductive section comes in contact with a front face of the fixed electrode or the movable electrode opposed to the stopper through deformation of the diaphragm.

2. The acoustic transducer according to claim 1, wherein the conductive section comprises a conductive film that covers at least a part of the stopper.

3. The acoustic transducer according to claim 2, wherein the back plate or the diaphragm from which the stopper protrudes includes an electrically insulating plate-shaped section, and an electrode film provided on a face of the plate-shaped section, which is on the side of the gap, serving as the fixed electrode or the movable electrode, and having an opening, wherein the stopper protrudes from the plate-shaped section while having a portion that is not covered with the electrode film, and wherein the conductive film of the stopper is provided in the opening of the electrode film.

4. The acoustic transducer according to claim 3, wherein the conductive film has a shape having no sharp corner on an outer edge thereof in a plan view.

5. The acoustic transducer according to claim 3, wherein the electrode film has a shape having no sharp corner on each edge thereof in a plan view.

6. The acoustic transducer according to claim 3, wherein the stopper protrudes from the back plate, and wherein the conductive film has a shape that is a polygon having, as vertices, centers of a plurality of sound holes that is adjacent to the stopper and that is provided in the back plate.

7. The acoustic transducer according to claim 6, wherein the conductive film and the electrode film each have a shape that does not include the sound holes in an insulating section configured to isolate the conductive film from the electrode film.

8. The acoustic transducer according to claim 3, wherein the stopper protrudes from the back plate, and wherein the conductive film is isolated from the electrode film by an insulating section passing through a plurality of sound holes provided in the back plate.

9. The acoustic transducer according to claim 3, wherein the electrode film and the conductive film are formed by separating a conductive member formed by the same process.

10. The acoustic transducer according to claim 3, wherein the conductive film has a shape that covers a top of the stopper.

11. The acoustic transducer according to claim 3, wherein a minimum distance between the conductive film and the electrode film is a distance larger than a value acquired by dividing a dielectric withstand voltage of a material for the plate-shaped section by a voltage applied between the fixed electrode and the diaphragm at detection of a vibration amount of the diaphragm.

12. The acoustic transducer according to claim 3, further comprising:

an electrically insulating second stopper protruding from the face of the back plate or the diaphragm, which is on the side of the gap and from which the stopper protrudes.

13. The acoustic transducer according to claim 12, wherein the second stopper is provided in an outer region of a region of the plate-shaped section where the electrode film is provided.

14. The acoustic transducer according to claim 1, wherein the stopper is a member that is electrically conductive also in a portion other than the conductive section.

15. The acoustic transducer according to claim 1, wherein the back plate or the diaphragm from which the stopper protrudes includes an electrode film having an opening, and wherein the stopper protrudes from the opening of the electrode film.

16. The acoustic transducer according to claim 1, wherein the back plate or the diaphragm from which the stopper protrudes includes an electrically insulating plate-shaped section, and an electrode film provided on a face of the plate-shaped section, which is on a side different from the side of the gap.

17. The acoustic transducer according to claim 1, wherein the back plate or the diaphragm from which the stopper protrudes is a member made of a conductive material.

18. The acoustic transducer according to claim 4, wherein the electrode film has a shape having no sharp corner on each edge thereof in a plan view.

19. The acoustic transducer according to claim 5, wherein the stopper protrudes from the back plate, and wherein the conductive film has a shape that is a polygon having, as vertices, centers of a plurality of sound holes that is adjacent to the stopper and that is provided in the back plate.

20. The acoustic transducer according to claim 6, wherein the stopper protrudes from the back plate, and wherein the conductive film has a shape that is a polygon having, as vertices, centers of a plurality of sound holes that is adjacent to the stopper and that is provided in the back plate.

* * * * *